US005825335A

United States Patent [19]

Arai et al.

[11] Patent Number: 5,825,335

[45] Date of Patent: Oct. 20, 1998

[54] SHEET ANTENNA APPARATUS

[75] Inventors: Hiroyuki Arai, Yokohama; Hiroshi Mura, Osaka; Hideo Sakata, Osaka; Takahiro Mizoguchi, Osaka; Kensuke Ishida, Osaka; Hiroshi Niimi, Osaka, all of Japan

[73] Assignee: Kubota Corporation, Osaka, Japan

[21] Appl. No.: 726,905

[22] Filed: Oct. 7, 1996

[30] Foreign Application Priority Data

| | | | |
|---|---|---|---|
| Oct. 23, 1995 | [JP] | Japan | 7-274506 |
| Dec. 15, 1995 | [JP] | Japan | 7-327360 |
| Mar. 25, 1996 | [JP] | Japan | 8-068307 |

[51] Int. Cl.[6] ..... H01Q 7/00

[52] U.S. Cl. ..... 343/866; 343/742; 343/842; 343/867

[58] Field of Search ..... 343/741, 742, 343/744, 770, 842, 866, 867

[56] References Cited

U.S. PATENT DOCUMENTS

| | | | |
|---|---|---|---|
| 2,673,931 | 3/1954 | Stevens | 343/810 |
| 3,261,019 | 7/1966 | Lundy | 343/742 |
| 4,251,808 | 2/1981 | Lichtblau | 343/842 |
| 5,198,826 | 3/1993 | Ito | 343/742 |
| 5,625,369 | 4/1997 | Newman | 343/770 |
| 5,663,738 | 9/1997 | Mueller | 343/742 |

FOREIGN PATENT DOCUMENTS 7-106834 4/1995 Japan .

*Primary Examiner*—Hoanganh T. Le
*Assistant Examiner*—Tho Phan
*Attorney, Agent, or Firm*—Oblon, Spivak, McClelland, Maier & Neustadt, P.C.

[57] ABSTRACT

A sheet antenna apparatus capable of favorably receiving vertically polarized electromagnetic waves is provided which includes an antenna element 11 comprising a main antenna portion 15 having a vertical segment 19, a pair of upper and lower lateral segments 20 and 21 respectively extending laterally from opposite ends of the vertical segment 19 and a pair of feeder segments 22 respectively extending inwardly from the terminating ends of the lateral segments 20 and 21, and a parasitic antenna element comprising an inner loop portion 16 and an outer loop portion 17 which form a double loop and are disposed as adjoining to one of the lateral segments 20 and 21. The vertical segment 19 of the antenna element 11 substantially coincides with the direction of vertically polarized electromagnetic waves and hence receives vertically polarized electromagnetic waves favorably. Further, when the frequency of received electromagnetic waves is high, the inner loop portion 16 becomes resonant with the main antenna portion 15, while when the frequency of received electromagnetic waves is low, the outer loop portion 17 becomes resonant with the main antenna portion 15. Thus, the antenna apparatus can successfully receive vertically polarized electromagnetic waves within an extensive frequency range.

11 Claims, 13 Drawing Sheets

CURRENT PROFILE AT 800MHz

CURRENT PROFILE AT 500MHz

CURRENT PROFILE AT 600MHz

CURRENT PROFILE AT 700MHz

SHEET ANTENNA APPARATUS

BACKGROUND OF THE INVENTION

1. Field of the Invention

The present invention relates to a sheet antenna apparatus formed integrally with a building material such as a roof material or a wall material.

2. Description of the Prior Art

There has been proposed a sheet antenna apparatus including a television-receiving antenna element integrally incorporated in a building material such as a roof material or a wall material in an attempt to avoid mar of the appearance of a building or to prevent damage of the antenna itself or reception troubles due to external factors such as rain and wind.

In one such prior art sheet antenna apparatus including, for example, an antenna element 2 integrally incorporated in a roof material 1 as shown in FIG. 16, the antenna element 2 comprises a lateral segment 3, a pair of vertical segments 4 respectively extending from the opposite ends of the lateral segment 3, a pair of feeder segments 5 respectively extending inwardly from the upper ends of the vertical segments 4, and feeding points 6 respectively provided in inner end portions of the feeder segments 5 and adapted to be connected to a TV receiver through a cable 7 (refer to, for example, Japanese Unexamined Patent Publication No. HEI 7-106834).

However, prior art sheet antenna apparatus of this type have an ordinary sheet configuration which is advantageous in receiving horizontally polarized electromagnetic waves but has a difficulty in receiving vertically polarized electromagnetic waves which rise vertically with respect to the surface of the building material. Specifically, the sheet antenna apparatus shown in FIGS. 16 and 17, though capable of satisfactorily receiving horizontally polarized electromagnetic waves having an electric field substantially parallel to the lateral segment 3, has a difficulty in receiving vertically polarized electromagnetic waves.

It is therefore conceivable to change the orientation of the antenna element of a sheet antenna apparatus adapted for horizontally polarized electromagnetic waves as shown in FIGS. 16 and 17 by 90° (or 270°), so as to provide an antenna element 2 capable of receiving vertically polarized electromagnetic waves which comprises a vertical segment 4, a pair of lateral segments 3 respectively extending laterally from the opposite ends of the vertical segment 4, and a pair of feeder segments 5 respectively extending inwardly from the terminating ends of the lateral segments 3 as shown in FIGS. 18 and 19.

However, the sheet antenna apparatus shown in FIGS. 18 and 19, when placed on the surface of a roof, has an antenna beam oriented perpendicular to the roof surface as shown in FIGS. 20 and 22 and hence cannot receive electromagnetic waves except those coming from above. To overcome this problem, a parasitic antenna element 9 is provided adjacent to one lateral segment 3 of the antenna element 2 as shown in FIG. 21. With this configuration it becomes possible to orient the antenna beam substantially horizontal as shown in FIG. 23, so that vertically polarized electromagnetic waves can be successfully received.

However, as the frequency of received electromagnetic waves becomes higher, the antenna element 9 comes to serve as a reflector and, consequently, the orientation of the antenna beam is reversed as shown in FIG. 24. As a result, the antenna apparatus can no longer receive vertically polarized electromagnetic waves successfully.

SUMMARY OF THE INVENTION

It is, therefore, an object of the present invention to provide a sheet antenna apparatus which is capable of advantageously receiving vertically polarized electromagnetic waves.

A sheet antenna apparatus according to one preferred embodiment of the invention comprises an antenna element formed integrally with a building material, the antenna element comprising a main antenna portion having a vertical segment, a pair of upper and lower lateral segments respectively extending laterally from opposite ends of the vertical segment and a pair of feeder segments respectively extending inwardly from terminating ends of the lateral segments, and a parasitic antenna element comprising an inner loop portion and an outer loop portion which form a double loop and are disposed as adjoining to one of the lateral segments.

In this configuration the vertical segment of the antenna element substantially coincides with the direction of vertically polarized electromagnetic waves and hence can receive vertically polarized electromagnetic waves advantageously. Further, when the frequency of received electromagnetic waves is high, the inner loop portion of the parasitic antenna element becomes resonant with the main antenna portion, while when the frequency of received electromagnetic waves is low, the outer loop portion of the parasitic antenna element becomes resonant with the main antenna portion. Thus, the antenna apparatus can successfully receive vertically polarized electromagnetic waves within an extensive frequency range.

These and other objects and many attendant advantages of this invention will be readily appreciated as the same becomes better understood by reference to the following detailed description when considered in connection with the accompanying drawings.

DESCRIPTION OF THE PREFERRED EMBODIMENTS

The present invention will now be described in detail with reference to the drawings.

Embodiment 1

Figure 1:
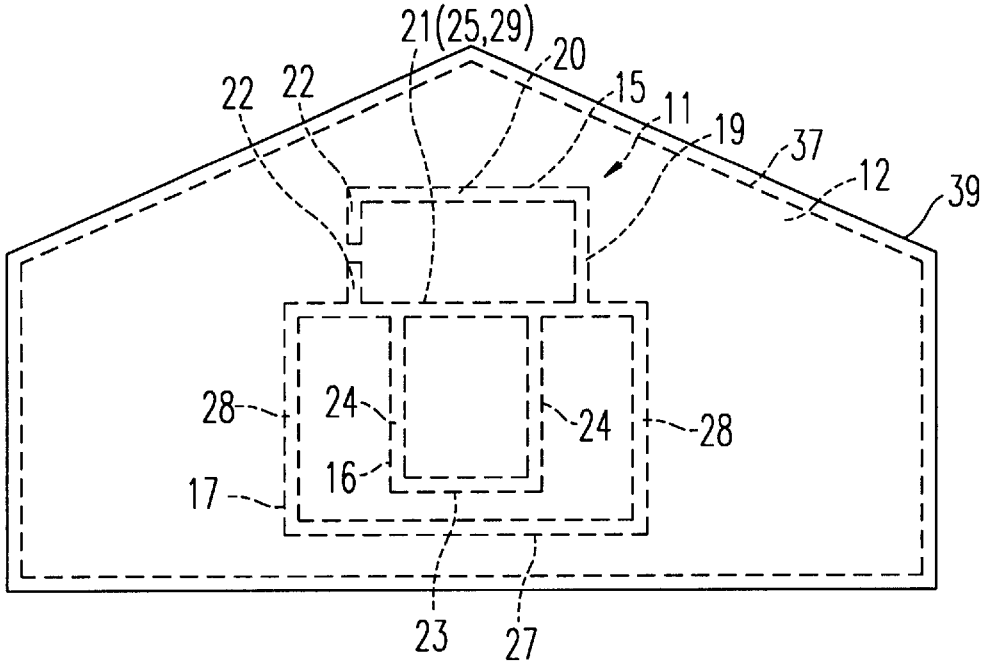
FIG. 1 is a front elevational view showing an antenna apparatus according to one embodiment of the present invention.
Figure 2:
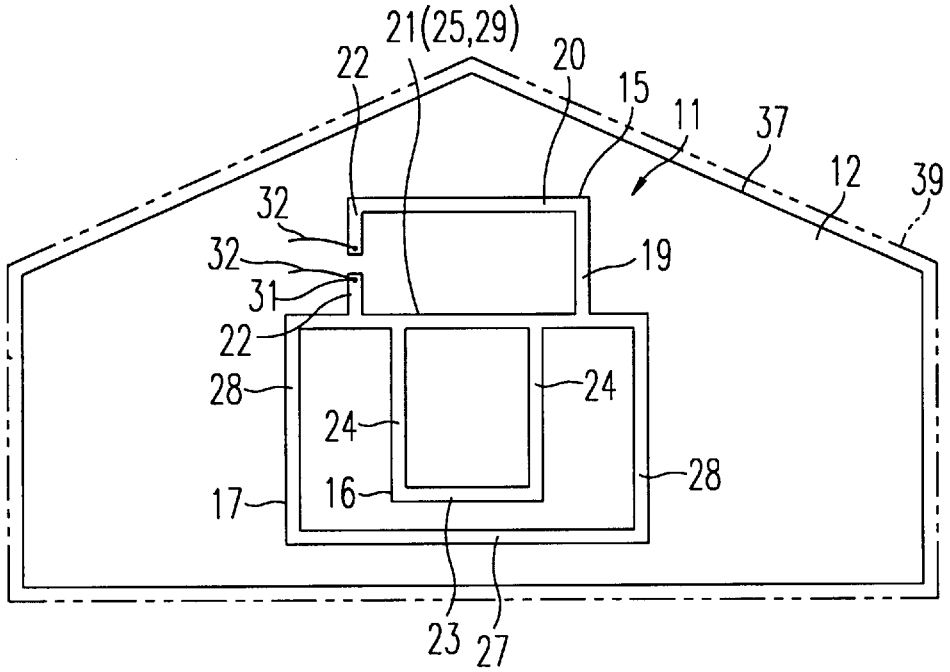
FIG. 2 is a front elevational view showing antenna element and antenna sheet of the antenna apparatus.
Figure 3:
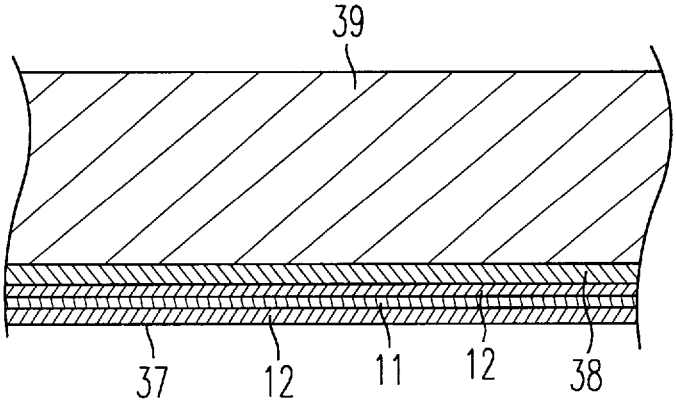
FIG. 3 is a fragmentary cross sectional view of the antenna apparatus.

Referring to FIGS. 1 to 3, an antenna apparatus according to the subject embodiment includes an antenna element 11 for receiving vertically polarized electromagnetic waves of UHF which is interposed between a pair of antenna sheets 12 formed of a plastic film. The antenna element 11 is formed by applying an electrically conductive coating material to a surface of one antenna sheet 12 or bonding an electrically conductive metallic foil material such as an electrically conductive tape to such surface. The other antenna sheet is superposingly bonded to the counterpart antenna sheet formed with the antenna element 11 using an adhesive so as to sandwich the antenna element 11 therebetween.

The antenna element 11 includes a main antenna portion 15, and a parasitic antenna element including an inner loop portion 16 and an outer loop portion 17 which form a double loop and are disposed as adjoining to the main antenna portion 15. The main antenna portion 15 has a vertical segment 19, a pair of upper and lower lateral segments 20 and 21 respectively extending laterally from the opposite ends of the vertical element 19, and a pair of feeder segments 22 respectively extending inwardly from the terminating ends of the lateral segments 21. The inner loop portion 16 has a lower lateral segment 23, a pair of vertical segments 24 respectively extending vertically upwardly from the opposite ends of the lower lateral segment 23, and an upper lateral segment 25 interconnecting the upper ends of the vertical segments 24, the upper lateral segment 25 being formed integrally with the lower lateral segment 21 of the main antenna portion 15. The outer loop portion 17 has a lower lateral segment 27, a pair of vertical segments 28 respectively extending vertically upwardly from the opposite ends of the lower lateral segment 27, and an upper lateral segment 29 interconnecting the upper ends of the vertical segments 28, the upper lateral segment 29 being formed integrally with the lower lateral segment 21 of the main antenna portion 15.

A pair of feeding points 31 are respectively provided in opposing end portions of the feeder segments 22 and adapted to connect to a TV receiver through a cable 32.

The lengths of respective segments of the antenna element 11 are, for example, as follows: vertical segment 19 of the main antenna portion 15=100 mm; each lateral segment 20,21 of the main antenna portion 15=200 mm; each lateral segment 23,25 of the inner loop portion 16=120 mm; each vertical segment 24 of the inner loop portion 16=160 mm; each lateral segment 27,29 of the outer loop portion 17=360 mm; and each vertical segment 28 of the outer loop portion 17 =180 mm.

An antenna body 37 comprising the antenna element 11, the pair of antenna sheets 12 and the like is bonded to the underside of a roof material 39 with an adhesive or a double-coated adhesive tape 38 in such a manner that one antenna sheet 12 faces opposite the underside of the roof material 39. Thus, the antenna element 11 is integrally formed with a building material, or the roof material 39 as shown in FIG. 3.

Figure 4:
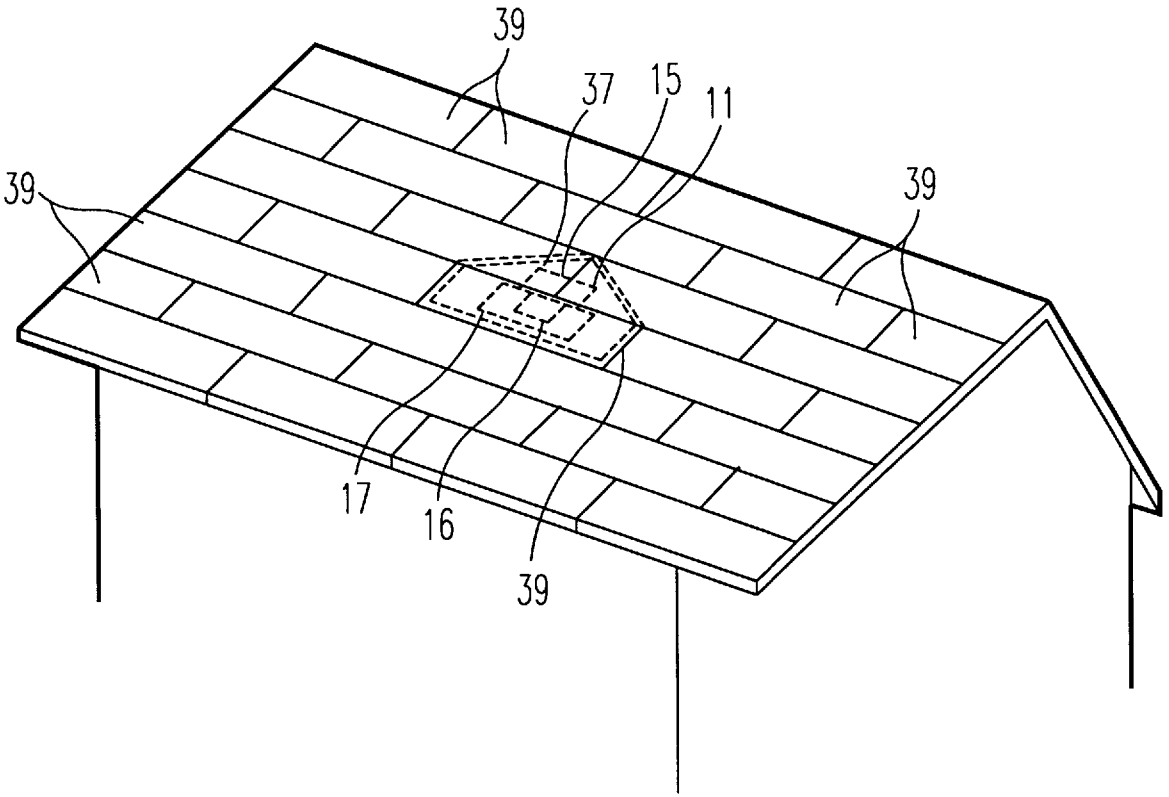
FIG. 4 is a perspective view showing the antenna apparatus as installed on a roof.

The roof material 39 integrally incorporating the antenna element 11 is to be disposed on the sheathing of a roof together with other roof materials as shown in FIG. 4.

Figure 5:
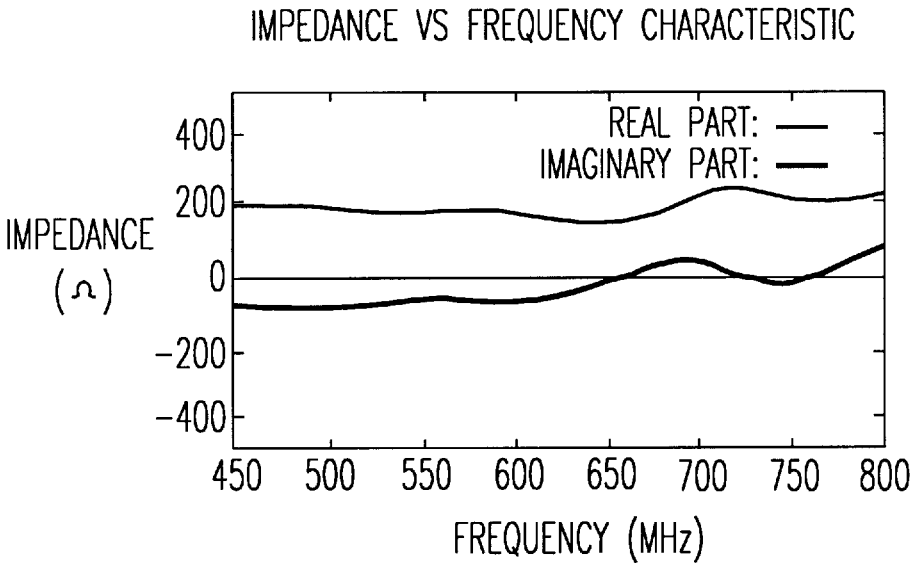
FIG. 5 is a graph for explaining the operation and effect of the antenna apparatus.
Figure 6:
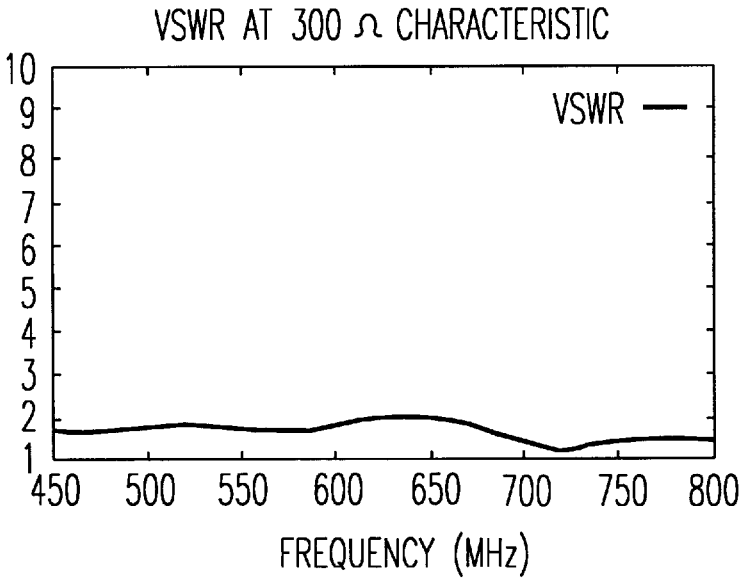
FIG. 6 is a graph for explaining the operation and effect of the antenna apparatus.
Figure 7:
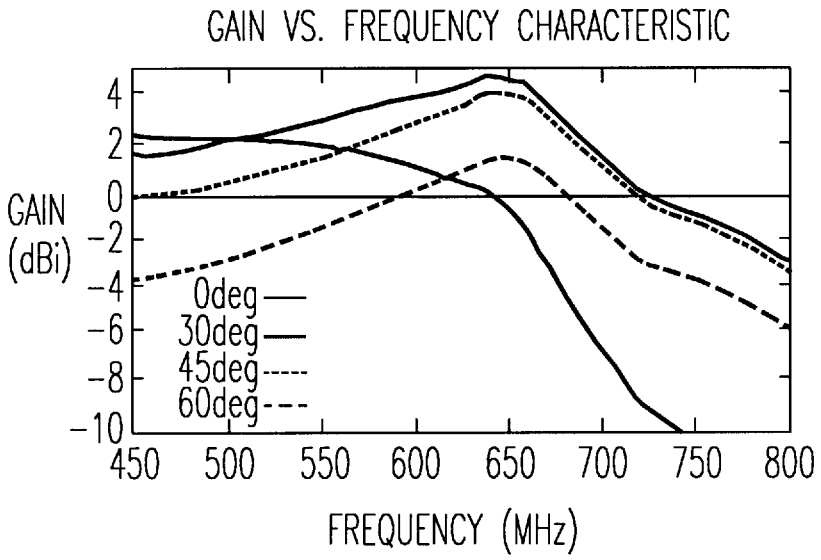
FIG. 7 is a graph for explaining the operation and effect of the antenna apparatus.

The impedance of the antenna element 11 according to this embodiment is about 300Ω as seen from FIG. 5 showing the impedance vs. frequency characteristic of the antenna element 11, and the voltage standing-wave ratio (VSWR) characteristic at 300Ω of the antenna element 11 is shown in FIG. 6. Further, the gain vs. frequency characteristic of the antenna element 11 at different tilt angles is shown in FIG. 7. As can be seen from these analyses, the antenna apparatus of the above configuration is capable of receiving vertically polarized electromagnetic waves of UHF advantageously. This is conceivably because: if the antenna beam oriented in the direction normal to the plane of the loop of an antenna model for receiving horizontally polarized electromagnetic waves is made to tilt by 90°, then this model becomes capable of receiving vertically polarized electromagnetic waves; and if an antenna element B which is sized smaller than a main antenna element A is provided adjacent thereto in the direction toward which the antenna beam is intended to tilt as shown in FIG. 8, then the current flows as in the director of a Yagi-Uda antenna so that the antenna beam is tilted.

Figure 8:
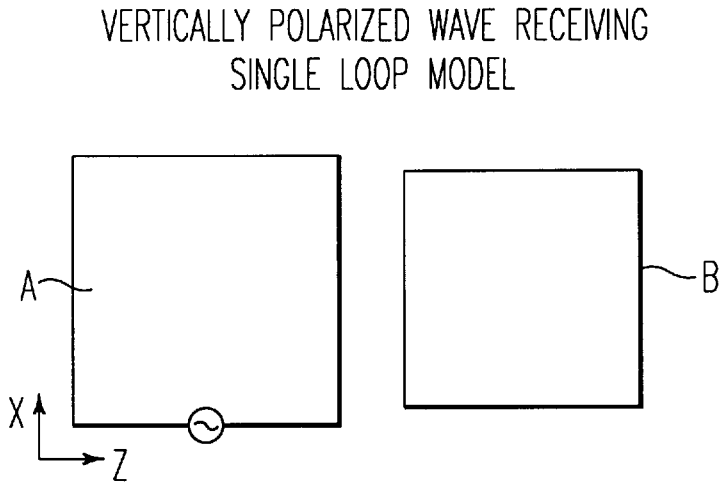
FIG. 8 is a front elevational view showing a single loop model for receiving vertically polarized electromagnetic waves for explaining the operation and effect of the apparatus.
Figure 9:
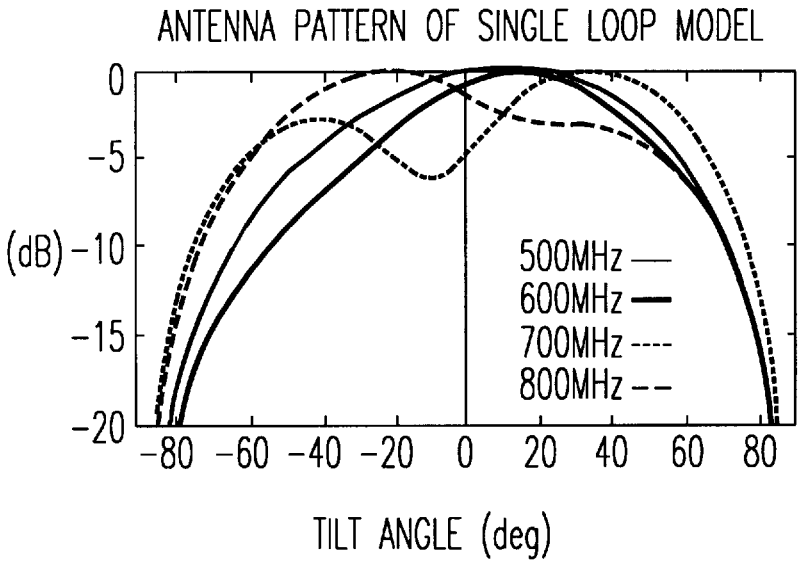
FIG. 9 is a graph for explaining the operation and effect of the antenna apparatus.
Figure 10:
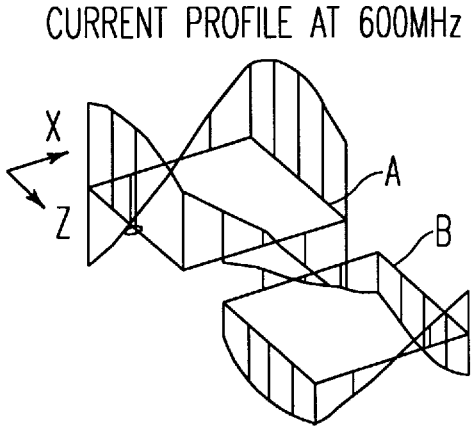
FIG. 10 is a perspective view showing a current profile for explaining the operation and effect of the apparatus.
Figure 11:
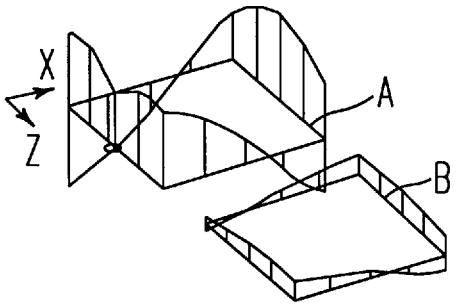
FIG. 11 is a perspective view showing a current profile for explaining the operation and effect of the apparatus.

FIG. 9 shows the results of analysis on the antenna pattern of the model including the antenna elements A and B shown in FIG. 8 at different frequencies. As can be seen therefrom, the antenna beam is successfully tilted about 40° at a frequency around a design frequency or 600 MHz. At a frequency higher than the design frequency, however, the antenna beam is tilted reversely. This is conceivably because as the frequency becomes higher, the antenna B provided as a director becomes longer relative to the frequency and consequently comes to serve as a reflector. Further, it is found from FIGS. 10 and 11 showing the results of analysis on current profile that common-mode current flows through the parallel antenna elements A and B at a frequency around the design frequency while when the antenna beam is tilted reversely, i.e., at a frequency higher than the design frequency, reverse phase current flows therethrough.

Figure 12:
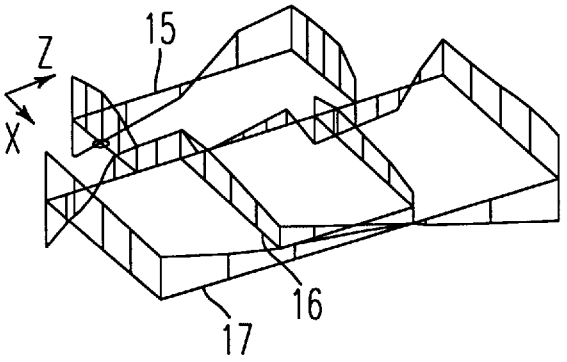
FIG. 12 is a perspective view showing a current profile for explaining the operation and effect of the apparatus.
Figure 13:
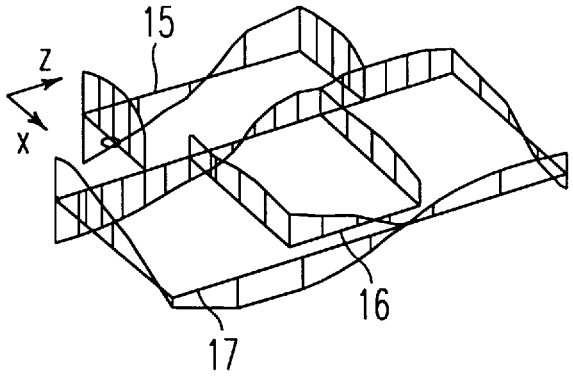
FIG. 13 is a perspective view showing a current profile for explaining the operation and effect of the apparatus.
Figure 14:
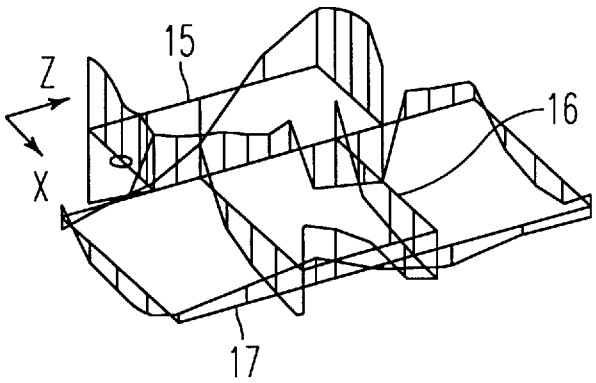
FIG. 14 is a perspective view showing a current profile for explaining the operation and effect of the apparatus.

Thus, the subject embodiment is provided with the inner and outer loop portions 16 and 17 disposed as adjoining to one lateral segment 23 of the main antenna portion 15 in order to prevent the occurrence of reverse phase current causing the antenna beam to tilt reversely. In addition the loop portions 16 and 17 are configured into a double loop structure in order for the antenna apparatus to be capable of receiving higher frequency bands. As apparent from FIGS. 12 to 14 respectively showing current profiles at 500 MHz, 600 MHz and 700 MHz of the antenna apparatus, the inner loop portion 16 resonates with the main antenna portion 15 when the frequency is relatively high, while the outer loop portion 17 resonates with the main antenna portion 15 when the frequency is relatively low. For this reason the antenna apparatus of the subject embodiment is capable of receiving vertically polarized electromagnetic waves of UHF advantageously.

It should be understood that although the antenna element 11 is interposed between the pair of antenna sheets 12 and the resulting antenna body is bonded to the roof material 39 in the above embodiment, instead antenna element 11 may be directly formed on a surface of a roof material by applying an electrically conductive coating material to such surface or bonding thereto an electrically conductive metallic foil material such as an electrically conductive tape.

Further, although the antenna element 11 is formed integrally with the roof material 39 in the above embodiment, instead the antenna element 11 may be formed integrally with a wall material or other building material.

Embodiment 2

Figure 15:
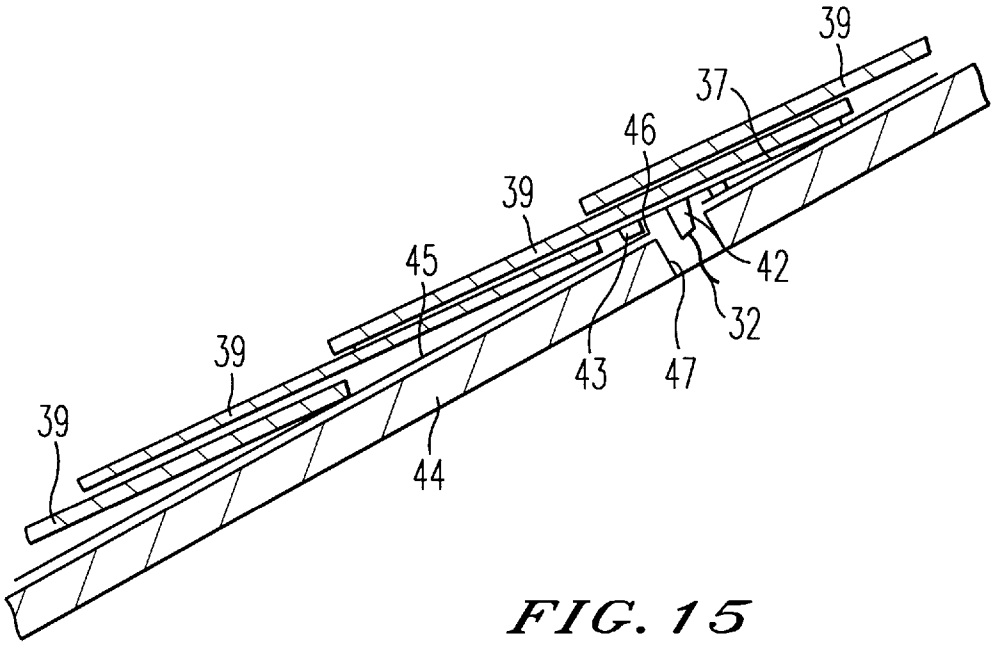
FIG. 15 is a cross sectional view showing another embodiment of the antenna apparatus according to the present invention.
Figure 16:
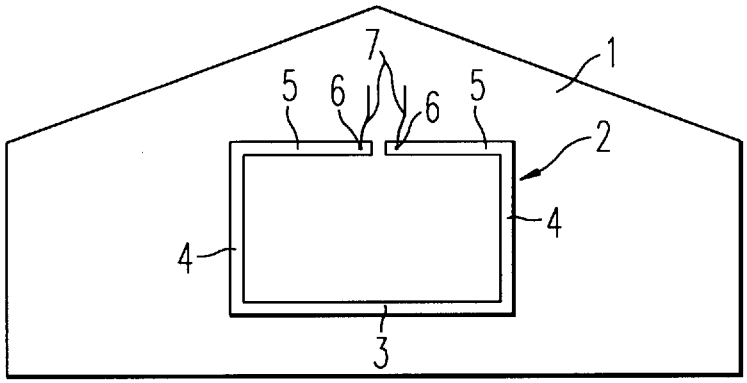
FIG. 16 PRIOR ART
FIG. 16 is a front elevational view of a conventional antenna apparatus.
Figure 17:
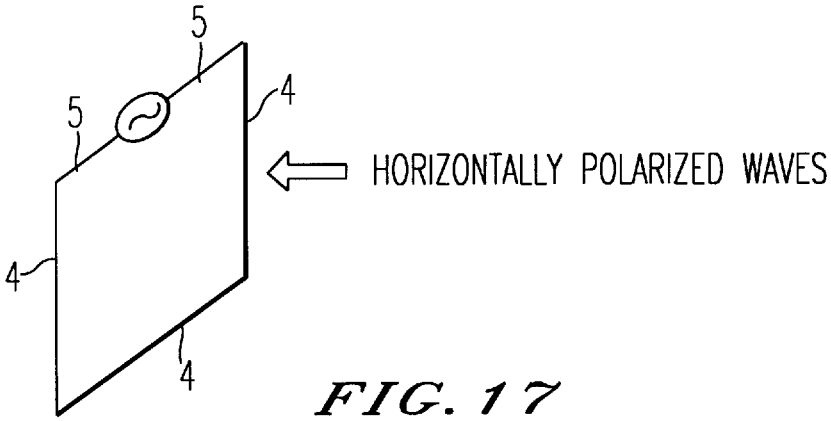
FIG. 17 PRIOR ART
FIG. 17 is a perspective view showing an antenna element of the conventional antenna apparatus.
Figure 18:
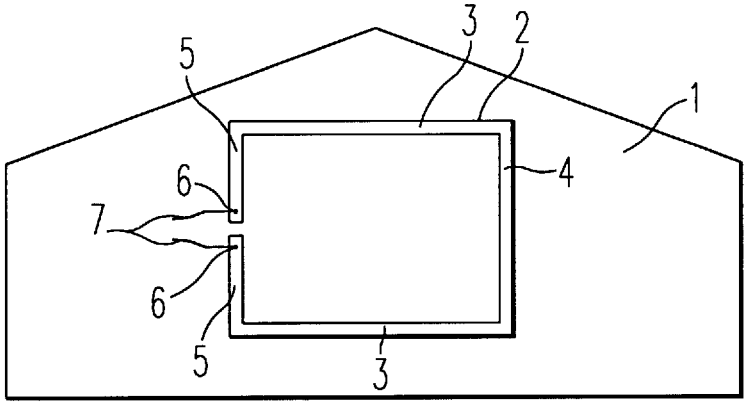
FIG. 18 PRIOR ART
FIG. 18 is a front elevational view showing another conventional antenna apparatus for explaining problems associated therewith.
Figure 19:
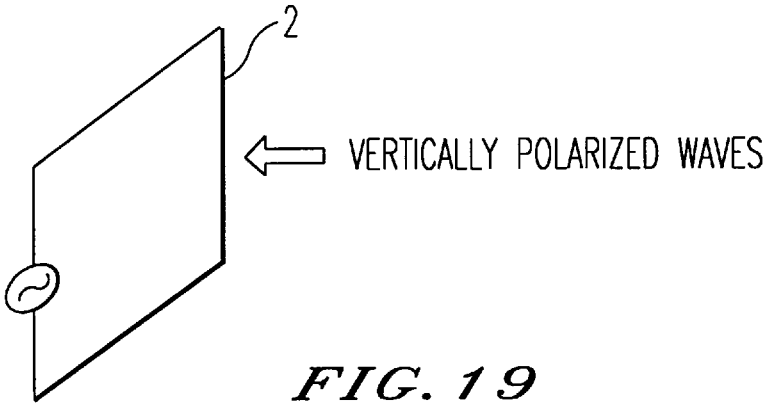
FIG. 19 PRIOR ART
FIG. 19 is a perspective view of an antenna element of the conventional antenna apparatus shown in FIG. 18.
Figure 20:
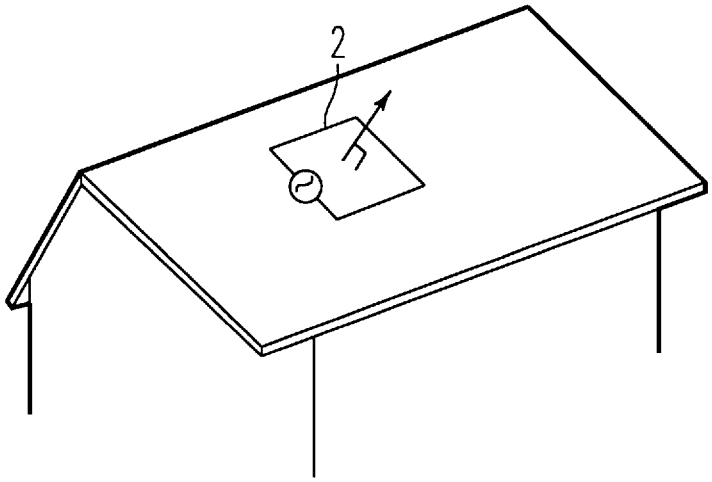
FIG. 20 PRIOR ART
FIG. 20 is a perspective view of the conventional antenna apparatus shown in FIG. 19 as installed on a roof.
Figure 21:
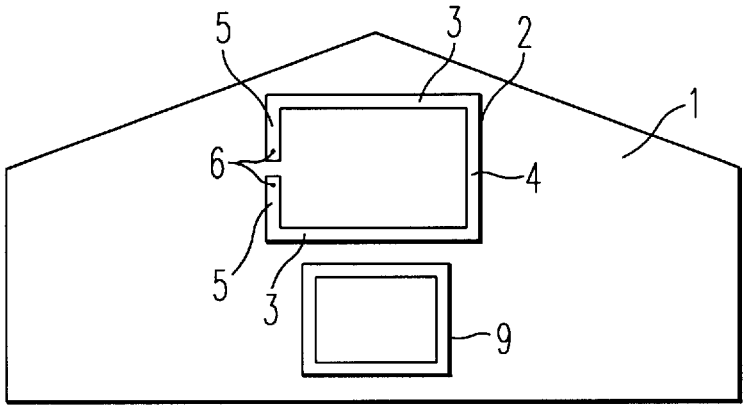
FIG. 21 PRIOR ART
FIG. 21 is a front elevational view showing still another conventional antenna apparatus for explaining problems associated therewith.
Figure 22:
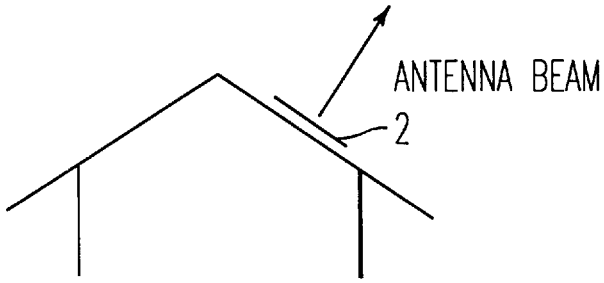
FIG. 22 PRIOR ART
FIG. 22 is a schematic view showing an antenna beam orientation of the conventional apparatus shown in FIG. 18.
Figure 23:
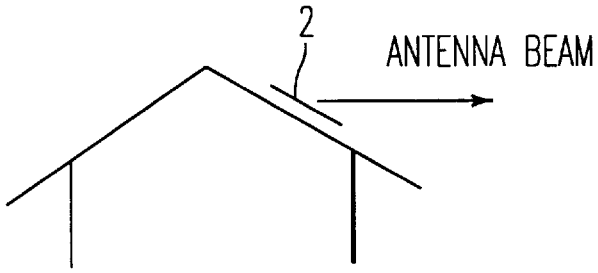
FIG. 23 is a schematic view showing an antenna beam orientation according to the present invention.
Figure 24:
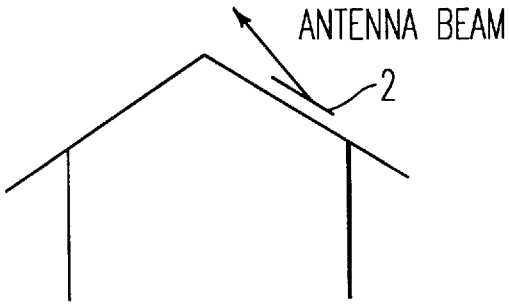
FIG. 24 PRIOR ART
FIG. 24 is also a schematic view showing an antenna beam orientation of the conventional apparatus shown in FIG. 21.

FIG. 15 shows an embodiment in which antenna body 37 formed integrally with a wall material or roof material 39 as shown in FIGS. 1 to 3 is installed on a roof.

The antenna body 37 shown in FIG. 15 includes antenna element 11 and a pair of antenna sheets 12 as shown in FIGS. 1 to 3, and is bonded to the underside of the roof material 39 with one antenna sheet 12 facing opposite that underside as shown in FIG. 3 and hence is formed integrally with a wall material or the roof material 39. The antenna element 11 includes main antenna portion 15, and an inner loop portion 16 and an outer loop portion 17 which form a double loop and are disposed as adjoining to the main antenna portion 15. The main antenna portion 15 has a vertical segment 19, a pair of upper and lower lateral segments 20 and 21 respectively extending laterally from the opposite ends of the vertical element 19, a pair of feeder segments 22 respectively extending inwardly from the terminating ends of the lateral segments 20 and 21, and a pair of feeding points 31 respectively provided in opposing end portions of the pair of feeder segments 22.

Further, as shown in FIG. 15, a feeding box 42 formed of, for example, a plastic housing is provided in a portion of the antenna sheet 12 corresponding to the position of the feeding points 31 in such a manner as to protrude downwardly therefrom. The pair of feeding points 31 of the antenna element 11 are connected to a cable 32 through a transformer and the like provided in the feeding box 42. The cable 32 is adapted to interconnect the antenna element 11 and a TV receiver.

On the antenna sheet 12 is provided a cylindrical sealing member 43 enclosing the feeding points 31 and protruding toward the peripheral edges of throughholes 46 and 47 to be described later. The sealing member 43 having a thickness of about 7 to about 15 mm is formed of a foamed material, cushion material or like material, and is bonded to the antenna sheet 12 so as to enclose the feeding box 42.

The roof material 39 integrally incorporating the antenna element 11, together with other roof materials, is disposed on sheathing 44 of a roof with intervention of a waterproof sheet 45 therebetween. The throughholes 46 and 47 for allowing the cable 32 to extend therethrough are formed in the waterproof sheet 45 and the sheathing 44, respectively, at positions corresponding to the position of the feeding points 31 of the antenna element 11. The sealing member 43 closely contacts the peripheral edge of the throughhole 46 of the waterproof sheet 45. The cable 32 connecting to the antenna element 11 extends through the throughholes 46 and 47 into the building for providing connection with the TV receiver.

With the construction of the above embodiment, it is possible to directly introduce the cable 32 connecting to the antenna element 11 into a building through the throughholes 46 and 47 respectively formed in the waterproof sheet 45 and the sheathing 44. Thus, there is no need to train the cable along external building materials such as roof materials, which would otherwise be needed for the conventional antenna apparatus, thereby simplifying the wiring of the cable 32 and eliminating possible damages to the waterproofness of a roof or wall materials. Particularly where the antenna element 11 is formed integrally with roof material 39, the cable 32 is no longer required to be trained along the surface of a roof, with the result that building materials, particularly roof materials, can be effectively prevented from being damaged such as by being trod on.

Further, since the sealing member 43 is provided on the antenna element side as enclosing the periphery of the feeding points 31, the sealing member 43 seals the clearance between the peripheral edge of the throughhole and the periphery of the feeding points 31 once the antenna apparatus is installed, so that there is no danger of deteriorating the waterproofness of the roof or wall despite the provision of the throughholes 46 and 47 in the waterproof sheet 45 and the sheathing 44, thus ensuring reliable waterproofness.

In addition, when the antenna apparatus is installed, the sealing member 43 provided on the antenna element side comes into close contact with the peripheral edge of the throughhole thereby providing easy and reliable waterproof seal without making the installation work complicated.

It should be noted that although the above embodiment has the sealing member 43 enclosing the periphery of the feeding points 31 and protruding toward the peripheral edges of the throughholes 46 and 47, the sealing member 43 may be disposed on the side of the waterproof sheet 45 or sheathing 44 in such a manner as to protrude from the peripheral edge of the throughhole 46 or 47 of the waterproof sheet 45 or sheathing 44 toward the antenna element 11 and enclose the periphery of the feeding points 31.

It should be further noted that although in the above embodiment the antenna element 11 is formed integrally with the roof material 39 with the underlying waterproof sheet 45 and sheathing 44 respectively defining the throughholes 46 and 47 at positions corresponding to the position of the feeding points 31 of the antenna element 11, instead the antenna element 11 may be formed integrally with a wall material. In this case waterproof sheet and wall material which are positioned inwardly of the wall material should define throughholes, respectively, at positions corresponding to the position of the feeding points 31 of the antenna element 11 so as to allow cable 32 to extend therethrough for providing connection between the antenna element 11 and a TV receiver.

Embodiment 1

The subject embodiment specifies the materials of the antenna element 11 and antenna sheets 12 of the antenna body 37 shown in FIGS. 1 to 3 so as to maintain the characteristics of the sheet antenna apparatus favorably over a long time.

As shown in FIGS. 1 to 3, antenna body 37 comprises antenna element 11, a pair of antenna sheets 12 and the like. The antenna element 11 includes main antenna portion 15, and an inner loop portion 16 and an outer loop portion 17 which form a double loop and are disposed as adjoining to the main antenna portion 15. The main antenna portion 15 has a vertical segment 19, a pair of upper and lower lateral segments 20 and 21 respectively extending laterally from the opposite ends of the vertical element 19, and a pair of feeder segments 22 respectively extending inwardly from the terminating ends of the lateral segments 20 and 21.

The antenna element 11 is preferably formed of a nickel foil having a thickness of about 10 to about 30 $\mu$m and is applied or bonded to a surface of one antenna sheet 12. The other antenna sheet 12 is superposed on that sheet so as to sandwich the antenna element 11 therebetween, the pair of antenna sheets 12 being then bonded to each other with an adhesive. The reason a nickel foil is preferred for the antenna element 11 is that a nickel foil has a greater tensile strength and a lower rate of diminution of strength due to corrosion than a copper foil.

Each of the antenna sheets 12 is preferably formed of a polyester-based plastic film having a thickness of 50 to 200$\mu$m. The reason a polyester-based plastic film is preferred for the antenna sheets 12 is that it is excellent in contraction-expansion properties, durability and the like over prolonged use. If the thickness of each antenna sheet 12 is smaller than 50 $\mu$m, such a thin plastic film requires a difficult and costly manufacturing process and is prone to be damaged. On the other hand, if it is larger than 200 $\mu$m, the film has excessively poor flexibility and suffers poor handling properties and degraded durability. Further, if the 200 $\mu$m thickness of each antenna sheet 12 exceeds 200 $\mu$m, the overall thickness of the roof material 39 including the antenna body 1 becomes excessively greater than other roof materials. This will result in inconveniences in building execution since the roof material 39 becomes likely to be broken by treading, which entails a possible deterioration of the waterproofness of a roof.

According to the above embodiment, the antenna element 11 is formed of a nickel foil and hence has a greater tensile strength and a lower rate of diminution of strength due to corrosion than an antenna element formed of a copper foil. Further, the antenna sheets 12 are formed of a polyester-based plastic film and hence are excellent in contraction-expansion properties, durability and the like. Since each antenna sheet 12 has a thickness of 50 $\mu$m or greater, a difficult and costly manufacture process required for a thinner sheet can be avoided and the antenna sheet 12 is hard to damage. Further, since each antenna sheet 12 is smaller than 200 $\mu$m in thickness, the sheet 12 enjoys a relatively high flexibility, good handling properties and enhanced durability. Thus, the sheet antenna apparatus according to the subject embodiment can maintain its characteristics favorably over a long time.

As has been described, the sheet antenna apparatus according to the present invention includes an antenna element comprising a main antenna portion having a vertical segment, a pair of upper and lower lateral segments respectively extending laterally from opposite ends of the vertical segment and a pair of feeder segments respectively extending inwardly from the terminating ends of the lateral segments. This configuration allows the vertical segment of the main antenna portion to coincide with the direction of vertically polarized electromagnetic waves thereby successfully receiving vertically polarized electromagnetic waves. The antenna apparatus according to the present invention further includes an inner loop portion and an outer loop portion which form a double loop and are disposed as adjoining to one of the lateral segments of the main antenna portion. When the frequency of received electromagnetic waves is relatively high, the inner loop portion resonates with the main antenna portion 15, while when the frequency of received electromagnetic waves is relatively low, the outer loop portion resonates with the main antenna portion. Thus, the antenna apparatus is capable of favorably receiving vertically polarized electromagnetic waves within an extensive frequency range.

While the presently preferred embodiments of the present invention have been illustrated in detail, it should be apparent that modifications and adaptations to those embodiments may occur to one skilled in the art without departing from the scope of the present invention as set forth in the following claims.

What is claimed is:

1. A sheet antenna apparatus comprising:

an antenna element formed integrally with a building material, the antenna element comprising, a main antenna portion having a vertical segment, a pair of upper and lower lateral segments respectively extending laterally from opposite ends of the vertical segment and a pair of feeder segments respectively extending inwardly from terminating ends of the lateral segments, and a parasitic antenna element including, an inner loop portion formed within an outer loop portion which together form a double loop and are disposed as adjoining to one of the lateral segments such that said main antenna and said parasitic antenna element cooperate so as to enable reception of vertically polarized electromagnetic waves.

2. A sheet antenna apparatus as set forth in claim 1, wherein:

the inner loop portion comprises a lower lateral segment, a pair of vertical segments respectively extending vertically upwardly from opposite ends of the lower lateral segment, and an upper lateral segment interconnecting respective upper ends of the vertical segments, the upper lateral segment being formed integrally with the lower lateral segment of the main antenna portion;

the outer loop portion comprises a lower lateral segment, a pair of vertical segments respectively extending vertically upwardly from opposite ends of the lower lateral segment, and an upper lateral segment interconnecting respective upper ends of the vertical segments, the upper lateral segment being formed integrally with the lower lateral segment of the main antenna portion; and the pair of feeder segments of the main antenna portion respectively have a pair of feeding points in respective opposing end portions thereof.

3. A sheet antenna apparatus as set forth in claim 2, wherein:

the building material comprises an exterior building material formed integrally with the antenna element; and the antenna element is provided with a seal member enclosing the feeding points of the antenna element, the seal member protruding toward a peripheral edge of a throughhole defined at a position corresponding to the position of the feeding points as extending through a portion of the building material positioned adjacent and inwardly of the exterior building material, the throughhole allowing a cable to extend therethrough into building for interconnecting the feeding points of the antenna element and a TV receiver to be installed in the building.

4. A sheet antenna apparatus as set forth in claim 2, wherein:

the building material comprises a roof material formed integrally with the antenna element; and the antenna element is provided with a seal member enclosing the feeding points of the antenna element, the seal member protruding toward a peripheral edge of a throughhole defined at a position corresponding to the position of the feeding points as extending, through a waterproof sheet and a sheathing of a roof which underlie the roof material, the throughhole allowing a cable to extend therethrough into a building for interconnecting the feeding points of the antenna element and a TV receiver to be installed in the building.

5. A sheet antenna apparatus as set forth in claim 2, wherein:

the building material comprises a roof material formed integrally with the antenna element; and a seal member is provided protruding toward the antenna element from a peripheral edge of a throughhole defined at a position corresponding to the position of the feeding points of the antenna element as extending through a waterproof sheet and a sheathing of a roof which underlie the roof material, the throughhole allowing a cable to extend therethrough into a building for interconnecting the feeding points of the antenna element and a TV receiver to be installed in the building.

6. A sheet antenna apparatus as set forth in claim 1, further comprising a pair of antenna sheets, wherein the antenna element is applied to a surface of one of the antenna sheets, and the other antenna sheet is superposingly bonded to said one of the antenna sheets so as to sandwich the antenna element therebetween.

7. A sheet antenna apparatus as set forth in claim 6, wherein:

the antenna element comprises an electrically conductive metallic foil material; and the antenna sheets each comprise a polyester-based plastic film having a thickness of from 50 to 200 $\mu$m.

8. A sheet antenna apparatus as set forth in claim 7, wherein the electrically conductive metallic foil material is formed of copper.

9. A sheet antenna apparatus as set forth in claim 7, wherein the electrically conductive metallic foil material is formed of nickel.

10. A sheet antenna apparatus as set forth in claim 1, further comprising an antenna body including the antenna element and a pair of antenna sheets, wherein the building material comprises a roof material having an underside to which the antenna body is bonded such that the antenna element is formed integrally with the building material.

11. A sheet antenna apparatus as set forth in claim 10, wherein the roof material formed integrally with the antenna apparatus is adapted to be disposed on a roof sheathing along with other roof materials.

* * * * *